US005740871A

United States Patent [19]

Williams

[11] Patent Number: 5,740,871

[45] Date of Patent: Apr. 21, 1998

[54] FLOW DIVERTER RING FOR A ROTARY DRILL BIT AND METHOD

[75] Inventor: Mark E. Williams, Grand Prairie, Tex.

[73] Assignee: Dresser Industries, Inc., Dallas, Tex.

[21] Appl. No.: 641,417

[22] Filed: May 1, 1996

[51] Int. Cl.[6] ..... E21B 10/22

[52] U.S. Cl. ..... 175/371; 76/108.4

[58] Field of Search ..... 175/57, 337, 371, 175/372; 76/108.4

[56] References Cited

U.S. PATENT DOCUMENTS

| | | | |
|---|---|---|---|
| 2,960,313 | 11/1960 | Goodwin . | |
| 3,013,621 | 12/1961 | Kinnear | 175/313 |
| 3,199,878 | 8/1965 | Cunningham et al. | 277/88 |
| 3,656,764 | 4/1972 | Robinson | 277/92 |
| 3,663,073 | 5/1972 | Bronson . | |
| 4,037,673 | 7/1977 | Justman | 175/371 |
| 4,179,003 | 12/1979 | Cooper et al. | 175/371 |
| 4,183,417 | 1/1980 | Levefelt | 175/339 |
| 4,190,301 | 2/1980 | Lachonius et al. . | |
| 4,199,156 | 4/1980 | Oldham et al. | 277/92 |
| 4,235,480 | 11/1980 | Olschewski et al. . | |
| 4,252,330 | 2/1981 | Crow | 277/92 |
| 4,290,497 | 9/1981 | Barnetche | 175/371 |
| 4,298,079 | 11/1981 | Norlander et al. | 175/339 |
| 4,613,004 | 9/1986 | Shotwell | 175/371 |
| 4,613,005 | 9/1986 | Olsson | 175/371 |
| 4,619,534 | 10/1986 | Daly et al. | 384/94 |
| 4,666,001 | 5/1987 | Burr | 175/371 |
| 4,671,368 | 6/1987 | Burr | 175/371 |
| 4,688,651 | 8/1987 | Dysart | 175/371 |
| 4,699,525 | 10/1987 | Mizobuchi et al. | 384/369 |
| 4,734,020 | 3/1988 | Inaba et al. | 418/55 |
| 4,762,189 | 8/1988 | Tatum | 175/371 |
| 4,765,205 | 8/1988 | Higdon | 76/108.2 |
| 4,825,964 | 5/1989 | Rives | 175/371 |
| 4,903,786 | 2/1990 | Welsh | 175/367 |
| 4,981,182 | 1/1991 | Dysart | 175/71 |

(List continued on next page.)

FOREIGN PATENT DOCUMENTS

| | | | |
|---|---|---|---|
| 398732 | 4/1974 | U.S.S.R. | 175/371 |
| 794154 | 2/1981 | U.S.S.R. | 175/371 |
| 1038465 | 8/1983 | U.S.S.R. | 175/371 |

OTHER PUBLICATIONS

Declaration of Mark E. Williams, executed Sep. 11, 1996, regarding U.S. Patent Application 08/641,417.

Correspondence, Security Division Dresser Industries, *New Seal Protection Concept*, dated May 18, 1994 (2 pages).

Chart, Journal and Cone Bearing Dimensions . . . Rework Information, dated Apr. 18, 1994 (5 pages).

Report, Security Engineering Division Dresser Industries, Inc., *Investigation Report No. 9274*, dated Aug. 15, 1994. (6 pages).

Memo, 11" SE338–ER7827, Undated. (1 page).

*Primary Examiner*—David J. Bagnell

*Attorney, Agent, or Firm*—Baker & Botts, L.L.P.

[57] ABSTRACT

A rotary cone drill bit for forming a borehole having a bit body with an upper end portion adapted for connection to a drill string. A number of angularly-spaced support arms formed to extend from the bit body. Each support arm has an inside surface with a spindle connected thereto and an outer surface. A number of cutter cones equal to a number of support arms are rotatably mounted on respective spindles. Each of the cutter cones includes an integral cylindrical cavity for receiving the respective spindle. A gap with a generally cylindrical portion is formed between the spindle and the cavity with a seal element disposed within the gap. The gap has an opening contiguous with the bottom edge of the outer surface and extending outwardly from the spindle. A bearing element is disposed within each gap between the exterior of the respective spindle and the interior of the respective cavity. A seal element is disposed within each gap to seal between the respective spindle and the interior of the respective cavity. A diverter ring is disposed on the exterior of each spindle approximate to the respective inside surface and located within the opening to the respective gap. The diverter ring comprises a disk having a plurality of ribs extending therefrom to divert abrasive fluids away from the gap.

22 Claims, 5 Drawing Sheets

U.S. PATENT DOCUMENTS

| | | | |
|---|---|---|---|
| 5,005,989 | 4/1991 | Karlsson | 384/94 |
| 5,056,610 | 10/1991 | Oliver et al. | 175/371 |
| 5,076,716 | 12/1991 | Mizobuchi et al. | 384/369 |
| 5,080,183 | 1/1992 | Schumacher et al. | 175/371 |
| 5,137,097 | 8/1992 | Fernandez | 175/228 |
| 5,358,061 | 10/1994 | Nguyen | 175/371 |
| 5,429,200 | 7/1995 | Blackman et al. | 175/371 |
| 5,513,711 | 5/1996 | Williams | 175/371 |
| 5,570,750 | 11/1996 | Williams | 175/371 |

FIG. 6
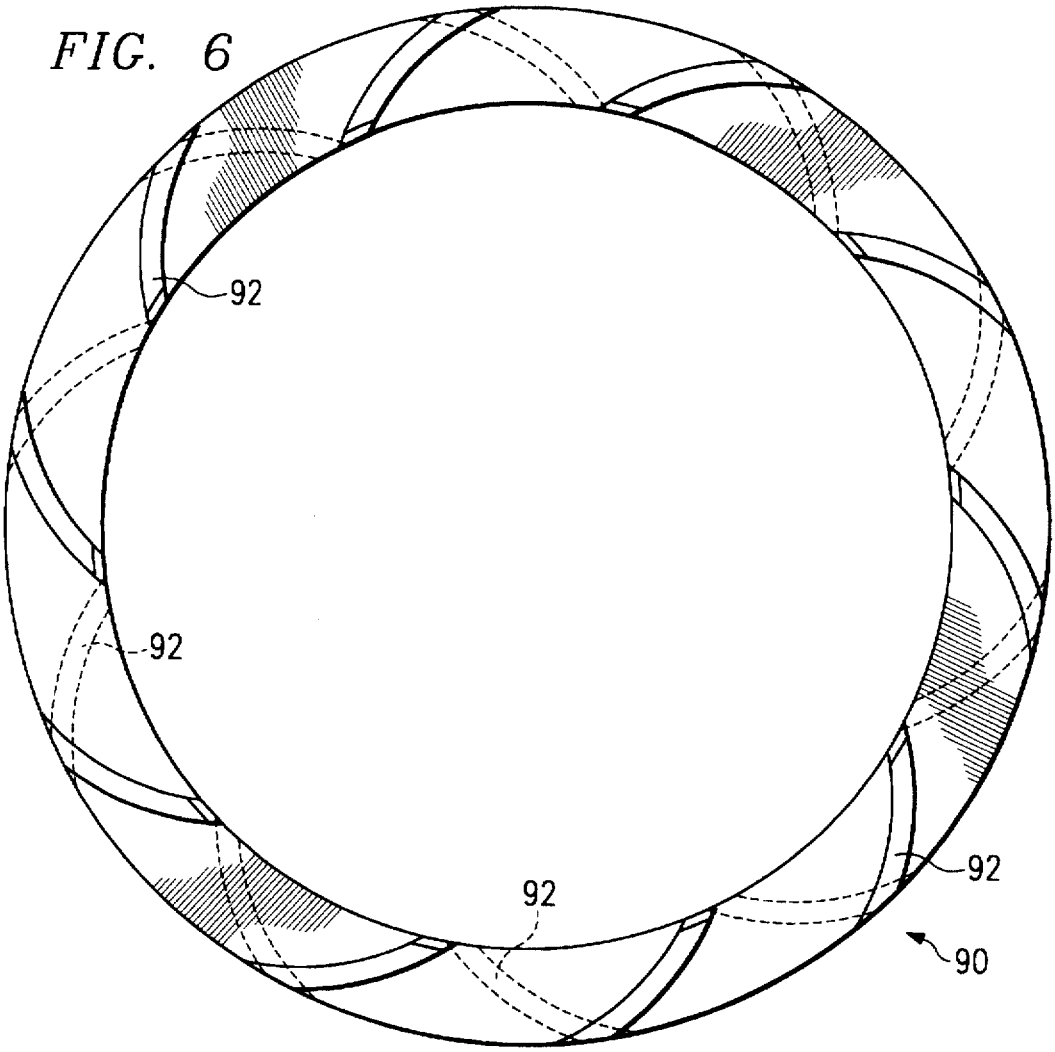
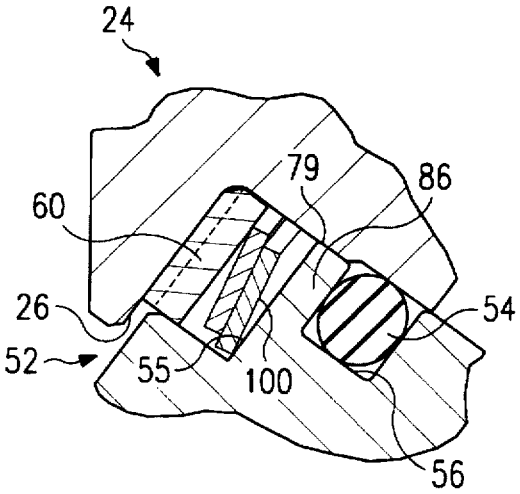
FIG. 7
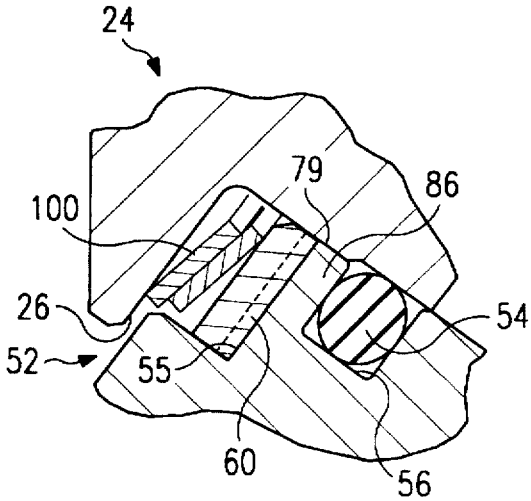
FIG. 8

FLOW DIVERTER RING FOR A ROTARY DRILL BIT AND METHOD

RELATED APPLICATION

This application is related to U.S. patent application Ser. No. 08/299,484 filed Aug. 31, 1994, now U.S. Pat. No. 5,513,711 entitled *A Sealed And Lubricated Rotary Cone Drill Bit Having An Improved Seal Protection* (Attorney's Docket 060220.0155) and to U.S. patent application Ser. No. 08/425,917 filed Apr. 20, 1995, now U.S. Pat. No. 5,570,750 entitled *Rock Bit With Improved Seal Protection* (Attorney Docket 060220.0191).

TECHNICAL FIELD OF THE INVENTION

The present invention relates generally to rotary drill bits used in drilling a borehole in the earth, and more particularly to a rotary cone drill bit with a flow diverter ring for enhancing seal protection of the rotary cone drill bit.

BACKGROUND OF THE INVENTION

One type of drill used in forming a borehole in the earth is a roller cone drill bit. A typical roller cone bit comprises a bit body with an upper end adapted for connection to a drill string. Depending from the lower portion of the bit body is a plurality of support arms, typically three, each with a spindle protruding radially inward and downward with respect to a projected rotational axis of the bit body. A cutter cone is generally mounted on each spindle and supported rotatably on bearings acting between the spindle and the inside of a spindle-receiving cavity in each cutter cone. One or more fluid nozzles are often formed on the underside of the bit body. The nozzles are typically positioned to direct drilling fluid passing downwardly from the drill string toward the bottom of the borehole being drilled. Drilling fluid washes away material removed from the bottom of the borehole and cleanses the cutter cones, carrying the cuttings and other debris radially outward and then upward within an annulus defined between the drill bit and the wall of the borehole.

Protection of bearings that allow rotation of the cutter cones from the drilling debris can lengthen the useful service life of a drill bit. Once drilling debris is allowed to infiltrate between bearing surfaces of the cutter cone and spindle, failure of the drill bit will follow shortly. Various mechanisms have been employed to help keep debris from entering between the bearing surfaces.

A typical approach is to place an elastomeric seal across a gap between the bearing surfaces of each cutter cone and its respective spindle support arm. However, seal failure is precipitated by abrasion due to the intrusion of cuttings into the seal area. Once the seal fails, it is not long before drilling debris contaminates the bearing surfaces via the gap between the cutter cone and its respective spindle. Thus, it is important that each seal also be protected against wear caused by debris in the borehole.

SUMMARY OF THE INVENTION

In accordance with the present invention, disadvantages and problems associated with previous rock bits and rotary cone drill bits have been substantially reduced or eliminated. One aspect of the present invention includes diverting abrasive fluids and particles away from sealing surfaces. Accordingly, the present invention provides increased protection from erosion and longer down hole drilling time for the associated drill bit. Another aspect of the present invention includes providing a diverter ring comprising a disk with ribs extending therefrom to divert abrasive cuttings and other debris from sealing surfaces. For some applications, ribs are formed on each surface of the diverter ring. For other applications, the diverter ring may have ribs on only one surface. The use of a diverter ring in accordance with the teachings of the present invention will substantially reduce and better protect the gap formed between each cutter cone and its respective support arm and spindle from erosion by down hole fluids and borehole debris.

A further aspect of the present invention includes providing a support arm and cutter cone assembly for a rotary cone drill bit with superior seal protection. For one application, each support arm may be integrally formed with its associated bit body and with an inner surface, an outer surface, and a bottom edge. The inner surface and the outer surface of each support arm are contiguous at the bottom edge. A spindle is attached to the respective inner surface and angled downward with respect to each support arm. The support arm and cutter cone assembly also includes a cutter cone having a cavity with an opening for receiving the respective spindle. Each support arm and cutter cone assembly further includes a seal for forming a fluid barrier in a gap formed between the interior of the cavity and the exterior of the spindle. Each gap also has an opening contiguous with the bottom edge of the respective support arm and in communication with any fluids or debris in the exterior of the drill bit. A diverter ring is disposed on the exterior of each spindle proximate to the respective inside surface and located within the opening to the respective gap. The diverter ring comprises a disk having a plurality of ribs extending therefrom to divert abrasive fluids away from the gap.

BRIEF DESCRIPTION OF THE DRAWINGS

For a more complete understanding of the present invention, and the advantages thereof, reference is now made to the following descriptions taken in conjunction with the accompanying drawings, in which:

FIG. 6 is a top plan view showing another embodiment of the diverter ring of the present invention; and FIG. 7 is an enlarged drawing in section with portions broken away showing the diverter ring coupled to the cutter cone in accordance with one embodiment of the present invention; and FIG. 8 is an enlarged drawing in section with portions broken away showing the diverter ring coupled to the support arm in accordance with another embodiment of the present invention.

DETAILED DESCRIPTION OF THE INVENTION

The preferred embodiments of the present invention and its advantages are best understood by referring to FIGS. 1–6 of the drawings, like numerals being used for like and corresponding parts of the various drawings.

Figure 1:
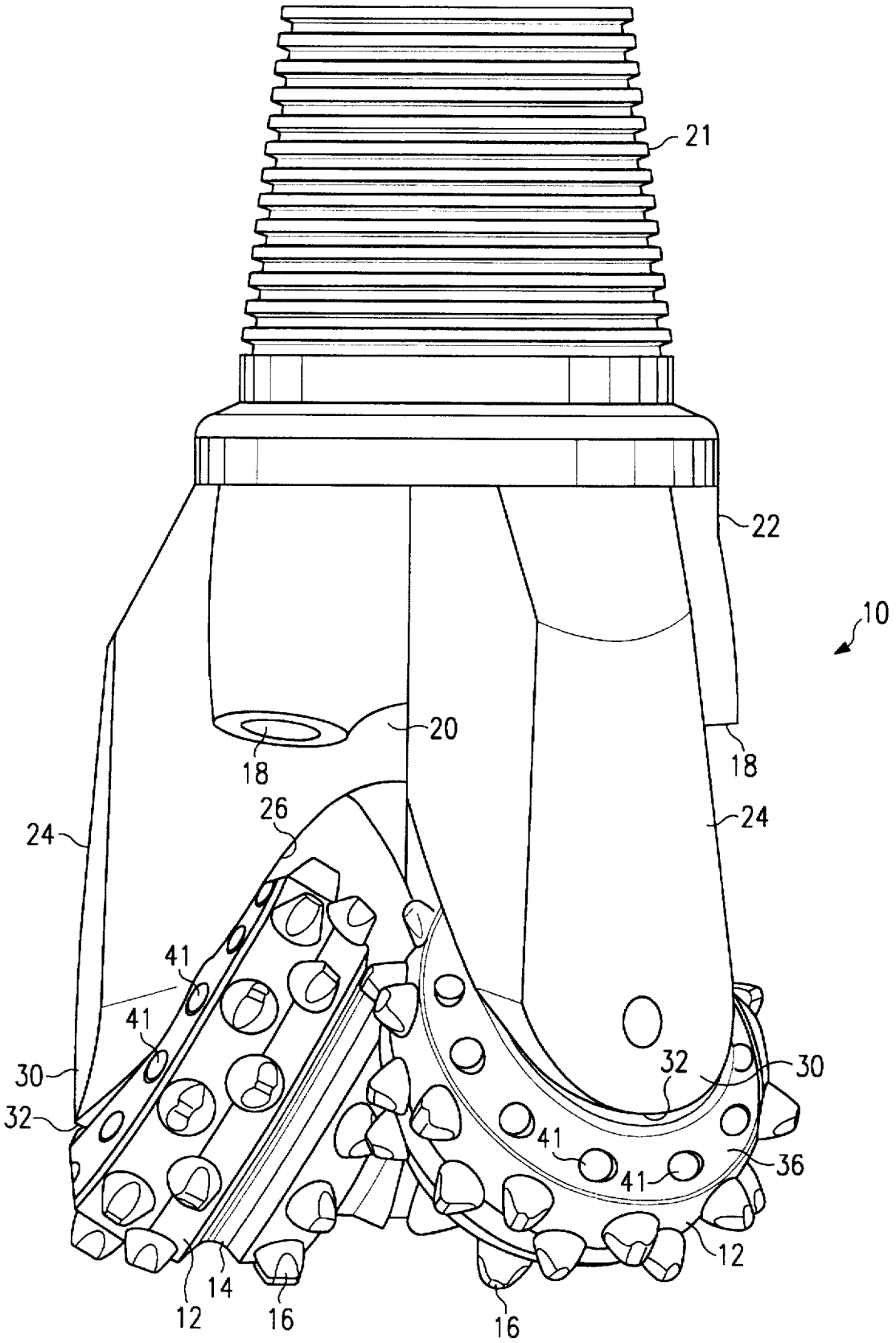
FIG. 1 is an isometric view of a rotary cone drill bit incorporating a diverter ring in accordance with the present invention.

For purposes of illustration, FIG. 1 shows one embodiment of the present invention represented by rotary cone drill bit 10 of the type used in drilling a borehole (not shown) in the earth. Rotary cone drill bit 10 may sometimes be referred to as a "rotary rock bit." With rotary cone drill bit 10, cutting action occurs as cone-shaped cutters 12 are rolled around the bottom of the borehole by rotation of a drill string (not shown) to which drill bit 10 is attached. Cutter cones 12 may sometimes be referred to as "rotary cutter cones" or "roller cutter cones" or "cone cutters."

As shown in FIG. 1, cutter cones 12 each include cutting edges formed by grooves 14 and protruding inserts 16 which scrape and gouge against the sides and bottom of a borehole under weight applied through a drill string. The down hole drilling debris thus created is carried away from the bottom of the borehole by drilling fluid ejected from nozzles 18 on underside 20 of drill bit 10. The debris-carrying fluid generally flows radially outward between underside 20 of drill bit 10 and the borehole bottom, and then flows upward toward the well head (not shown) through an annulus (not shown) defined between the exterior of drill bit 10 and the inside wall (not shown) of the borehole.

Rotary cone drill bit 10 comprises an enlarged bit body 22 with a tapered, externally-threaded upper section 21 adapted to be secured to the lower end of a drill string. Depending from bit body 22 are three support arms 24. Only two support arms 24 are visible in FIG. 1. Each support arm 24 preferably includes inside surface 26 with spindle 28 extending therefrom. See FIGS. 2 and 3.

The lower portion of each support arm 24 preferably includes an outer surface or shirttail surface 30. Inside surface 26 and shirttail surface 30 are contiguous with each other at bottom edge 32 of each support arm 24. Spindles 28 are preferably angled downwardly and inwardly with respect to longitudinal axis 23 of bit body 22 so that as drill bit 10 is rotated, the exterior of each cutter cone 12 engages the bottom of the borehole. For some applications, spindles 28 may also be tilted at an angle of zero to three or four degrees in the direction of rotation of drill bit 10.

Each cutter cones 12 may be constructed and mounted on its associated spindle 28 in a substantially identical manner except for the respective pattern of the rows of inserts 16. Accordingly, only one support arm 24 and cutter cone 12 is described in detail, since the same description applies generally to the other support arm and assemblies.

Figure 2:
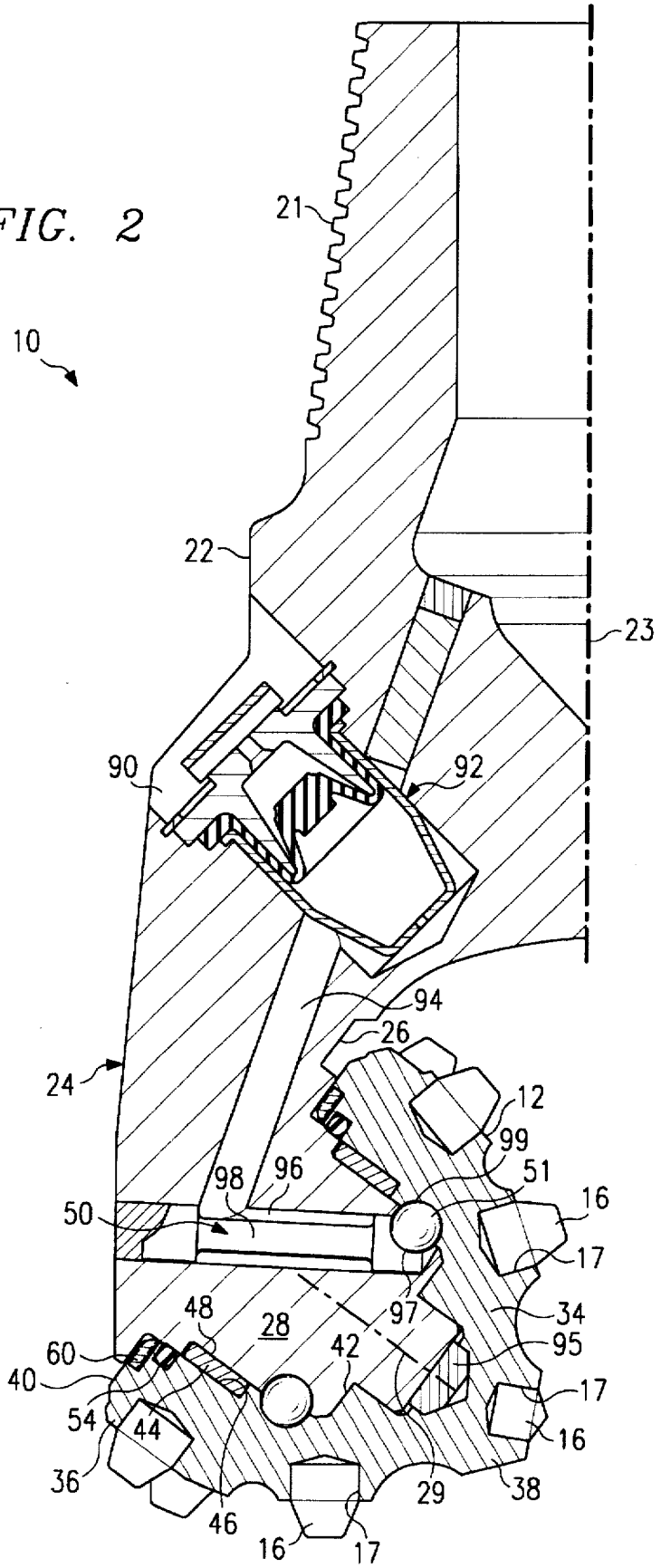
FIG. 2 is a drawing in section with portions broken away showing a support arm and cutter cone assembly associated with the rotary cone drill bit of FIG. 1.
Figure 3:
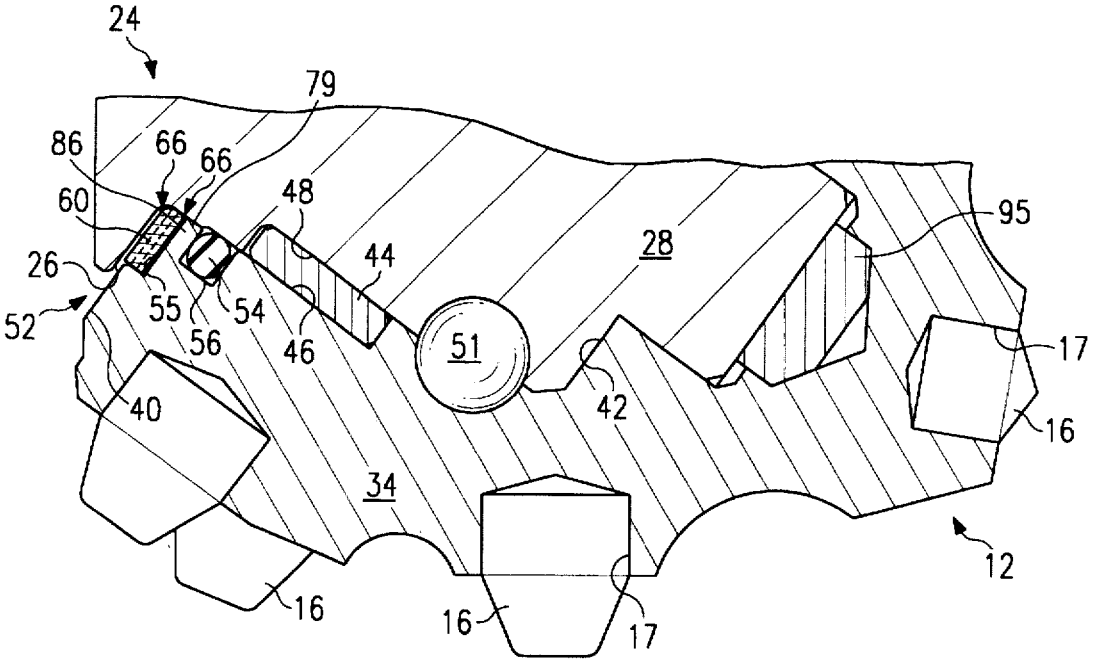
FIG. 3 is an enlarged drawing in section with portions broken away showing a portion of the support arm and cutter cone assembly of FIG. 2.

As shown in FIGS. 2 and 3, inserts 16 are mounted within respective sockets 17 formed in cutter cone body 34. Cutter cone body 34 includes base portion 36 and nose 38 extending therefrom. Base portion 36 preferably includes backface surface 40 which extends radially relative to central axis 29 of spindle 28. When cutter cone 12 is mounted on spindle 28, backface surface 40 will be aligned substantially parallel with adjacent portions of inside surface 26 on support arm 24. For most applications, as shown in FIG. 1, pressed inserts and/or surface compacts 41 are provided in base portion 36 to minimize or prevent erosion and wear of the respective cutter cones 12.

Opening inwardly from backface surface 40 is a generally cylindrical cavity 42 for receiving spindle 28. A suitable bearing 44 is generally mounted in cutter cone 12. A conventional ball retaining system 50 secures cutter cone 12 to spindle 28.

For the embodiment shown in FIG. 2, support arm 24 includes lubricant cavity 90, lubricant pressure compensation system 92 and lubricant passage 94 to provide the desired lubricant to various components associated with cutter cone 12 and spindle 28. One or more passageways (not shown) may be provided within spindle 28 to provide lubricant to ball retainers 51, bearing 44 and/or seal element 54 as desired for anticipated down hole conditions. Thrust button 95 may be provided within cavity 42 for engagement with the extreme end of spindle 28. Lubricant may also be supplied to thrust button 95 if desired for the specific down hole application. The diverter ring of the present invention may be used with a wide variety of support arm and cutter cone assemblies having various types of lubricating systems including systems associated with air drilling. The present invention is not limited to use with support arms and cutter cones assemblies having the lubricating system shown in FIG. 2.

Ball retaining system 50 includes ball passageway 96. Cutter cone 12 is retained on spindle 28 by inserting a plurality of ball bearings 51 through ball passageway 96. Ball bearings 51 reside in an annular array within cooperatively associated ball races 97 and 99 formed in the exterior of spindle 28 and the interior of cavity 42 respectively. Once inserted, ball bearings 51 prevent the disengagement of cutter cone 12 from spindle 28. Ball passageway 96 is subsequently plugged with ball plug 98 using conventional techniques. Again, the enhanced shirttail and seal protection features of the present invention may be used with a wide variety of support arm and cutter cone assemblies and is not limited to use with a support arm and cutter cone assembly having ball retaining system 50 as shown in FIG. 2.

Spindle 28 has a generally cylindrical exterior surface and cavity 42 has a generally cylindrical interior surface. To allow cutter cone 12 to be rotatably mounted on spindle 28 the outside diameter of spindle 28 is less than the inside diameter of the adjacent portion of cavity 42. Thus, a generally cylindrical gap is formed between the exterior of spindle 28 and the interior of cavity 42. The various segments of the resulting gap are defined by adjacent surfaces of spindle 28 and cavity 42 such as bearing surfaces 46 and 48 and ball races 97 and 99. As shown in FIG. 3, outer segment 52 of the gap extends radially outward from the exterior of spindle 28 between backface surface 40 of cutter cone body 34 and the adjacent portions of inside surface 26 on support arm 24.

As best shown in FIG. 3 bearing 44 is disposed within the gap between exterior surface 48 of spindle 28 and interior surface 46 of cavity 42. Seal element 54 is disposed between the exterior of spindle 28 and the interior of cavity 42 axially spaced from bearing 44. Seal element 54 is also located within the gap between outer segment 52 and bearing 44 to retain bearing lubricant and to block well fluids and down hole debris from contacting bearing surfaces 46 and 48 which would damage these surfaces and/or bearing 44 leading ultimately to failure of drill bit 10.

Diverter ring 60 is disposed around spindle 28 within annular recess 55, which is between inside surface 26 and backface surface 40. Clearance gap 66 is formed between diverter ring 60 and backface surface 40 and between diverter ring 60 and inside surface 26. As will be described in detail below, the diverter ring 60 forces or "pumps" cuttings and other debris away from seal 54 during drilling operations. As a result, diverter ring 60 of the present invention extends the lifetime of the seal 54 and thus the lifetime of the drill bit 10.

Figure 4:
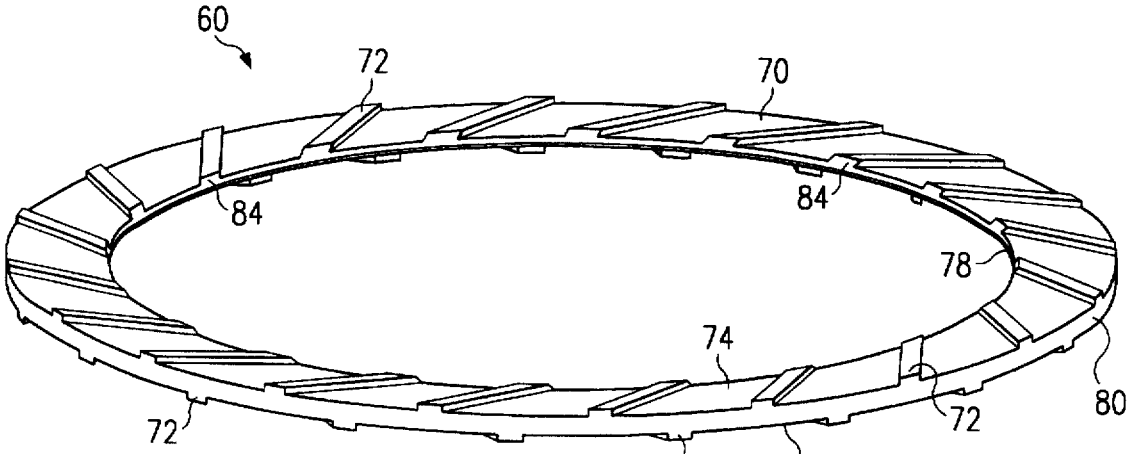
FIG. 4 is a perspective view showing one embodiment of the diverter ring of the present invention.
Figure 5:
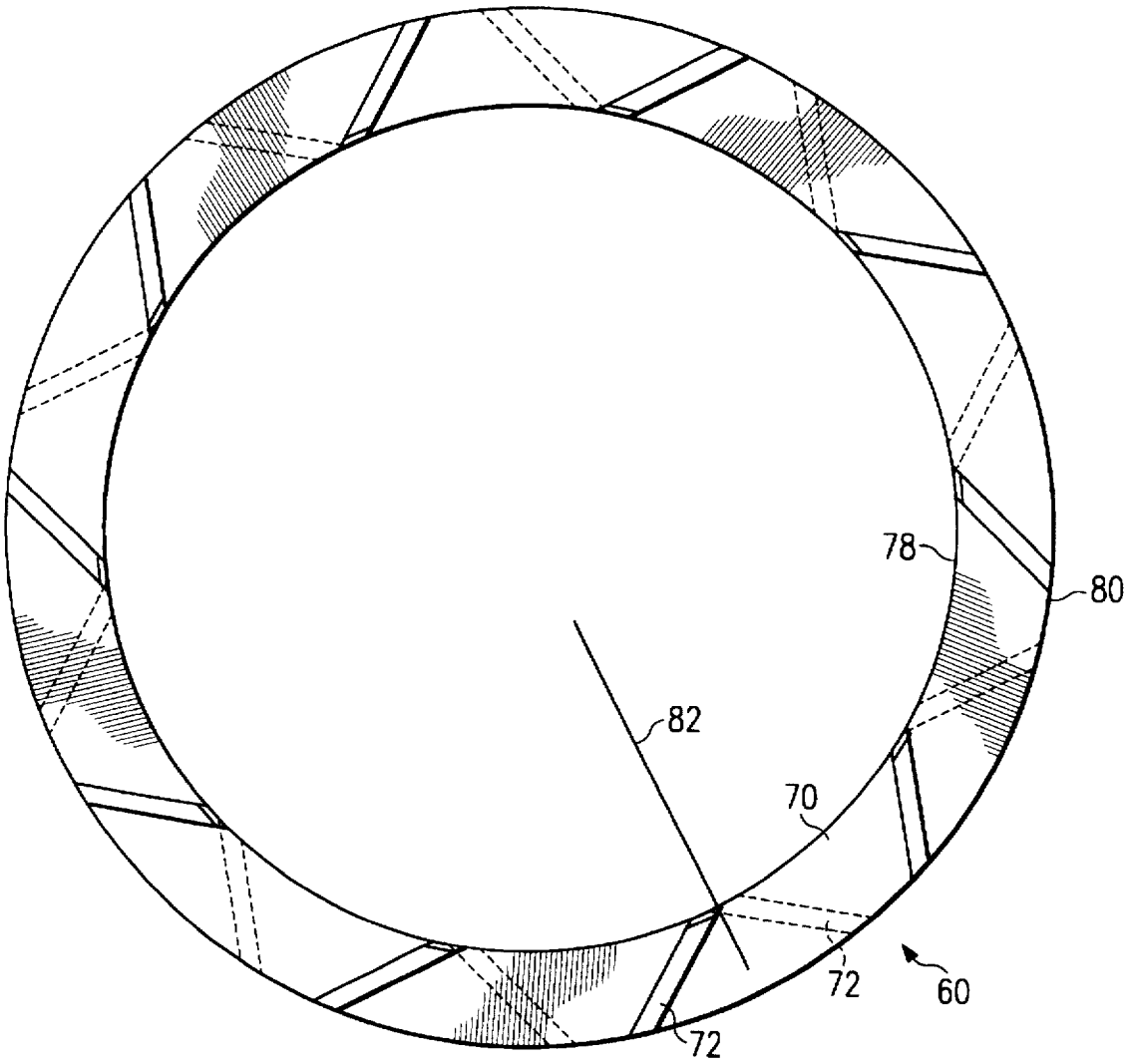
FIG. 5 is a top plan view of the diverter ring of FIG. 4.

As shown in FIGS. 4 and 5, diverter ring 60 is a generally flat, cylindrical disk 70 having a series of ribs 72 protruding therefrom on a first side 74 and on a second opposite side 76. Inside diameter 78 of diverter ring 60 is slightly larger than the outside diameter portion 79 of the spindle 28. Outside diameter 80 of diverter ring 60 is selected in accordance with the teachings of the present invention to be less than the diameter of backface surface 40 of cutter cone 34 and to fit within annular recess 55. Accordingly, diverter ring 60 is free to rotate around spindle 28 relative to inside surface 26 of the support arm 24 and annular recess 55 of cutting cone 34.

A significant feature of the embodiment shown in FIGS. 2, 3 and 4 is the rotation of diverter ring 60 relative to inside surface 26 of the support arm 24 and to annular recess 55 of cutting cone 34. Relative rotation is accomplished by controlling the size of clearance gap 66 by sizing the thickness of diverter ring 60 and the thickness of annular recess 55. As a result, as the drill string turns rotary drill bit 10 and cutter cone 34 rotates around spindle 28, diverter ring 60 rotates around spindle 28 at a speed greater than that of inside surface 26 of support arm 24, which does not rotate, and at a speed less than the rotation of the cutter cone 34. Thus, diverter ring 60 rotates relative to both inside surface 26 and support arm 24 and annular recess 55 in backface surface 40 of cutter cone 34.

For the embodiment shown in FIGS. 2 and 3, clearance gap 66 is about 5 thousandths of an inch. Cylindrical disk 70 and ribs 72 on each side thereof each have a thickness of about 50 thousandths of an inch. The present invention allows the use of manufacturing techniques to closely control the size of clearance gap 66 within very close tolerances. The dimensions of diverter ring 60, however, may be varied as desired to minimize manufacturing costs while optimizing down hole performance of the associated drill bit 10. For example, depending on the size of the drill bit 10 used, the thickness of the diverter ring 60 could be substantially either decreased or increased as desired.

As best shown by FIG. 5, ribs 72 on first side 74 of diverter ring 60, which face inside surface 26 on support arm 24, are preferably angled at between 15 and 75 degrees away from the direction of rotation of diverter ring 60, as measured from a radius 82 at the inside diameter 78 of diverter ring 60. During drilling operations, ribs 72 on first side 74 force cuttings and other debris outward of the gap and thus away from seal 54. Ribs 72 on second side 76 of diverter ring 60, which face annular recess 55 of backface 40 of cutter cone 34, are angled at between 15 and 75 degrees toward the direction of rotation of diverter ring 60, as measured from radius 82 at the inside diameter 78 of diverter ring 60. Ribs 72 on second side 76 are angled opposite ribs 72 on first side 74 because cutter cone 34 rotates faster than diverter ring 60. Accordingly, during drilling operations, cuttings and debris are pushed against the backside of ribs 72 on second side 76 by the rotation of the cutter cone 34 and then forced along the backside outward of the gap and thus away from seal 54.

For some applications, chamfered surface 84 may be formed on the interior of ribs 72 on first side 74 of diverter ring 60. Chamfered surface 84 provides clearance between diverter ring 60 and the radius at the base of the spindle 28.

For the embodiment of the invention shown in FIGS. 2 and 3, groove 56 is formed within cavity 42 spaced axially from backface surface 40. This configuration provides flange 86 between seal element 54 and diverter ring 60. Flange 86 protects seal element 54 from the hard abrasive materials associated with diverter ring 60 and thus increases the down hole service life for seal element 54.

Since diverter ring 60 is a separate component, a wide variety of materials and fabricating techniques may be used to form diverter ring 60. Diverter ring 60 is preferably formed from conventional steel that is ion-nitrided or boronized for erosion resistance. Diverter ring 60 may also be formed of a composite material and includes a nonheat-treatable hard metal component having a higher degree of hardness than found in prior support arms and cutter cone assemblies.

In a second embodiment, as shown in FIG. 6, diverter ring 90 is essentially the same as previously described diverter ring 60 except that ribs 92 are curved to provide a more gradual slope for forcing cuttings and other debris from the gap and thus away from seal 54.

In another embodiment, the diverter ring 60 may only comprise ribs 72 on one side. For example, diverter ring 60 may only comprise ribs 72 first side 74. In such an embodiment, as shown by FIG. 7, second side 76 is coupled to annular recess 55 of cutter cone 34. Accordingly, debris cannot pass between diverter ring 60 and cutter cone 34. The method of coupling the ring 60 to the arm or cone 34 could include a means of energizing the ribs 72 against the opposing surface. The energizer 100 could be an o-ring, rubber washer, or metallic spring. Diverter ring 60 rotates directly with cutter cone 34. Ribs 72 on first side 74 force cuttings and other debris outward of the gap and thus away from seal 54. Alternately, diverter ring 60 may only comprise ribs 72 second side 76. In such an embodiment, as shown by FIG. 8, first side 74 is coupled to inside surface 26 on support arm 24. Accordingly, debris cannot pass between diverter ring 60 and support arm 24. Diverter ring 60 does not rotate. The rotation of cutter cone 34 force cuttings and debris against the backside of ribs 72 on second side 76 and then outward of the gap and thus away from seal 54.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole, said drill bit comprising:

a bit body with an upper end portion adapted for connection to a drill string for rotation about a longitudinal axis of the bit body;

a number of angularly-spaced support arms integrally formed with the bit body and depending therefrom, each of the support arms having an inside surface with a spindle connected thereto and an outer surface;

each spindle projecting generally downwardly and inwardly with respect to the longitudinal axis of the bit body and having a generally cylindrical upper end portion connected to the inside surface of the respective support arm;

a plurality of cutter cones equaling the number of support arms and rotatably mounted on one of the respective spindles;

each of the cutter cones including an internal generally cylindrical cavity for receiving the respective spindle;

a generally cylindrical gap formed between the exterior of each spindle and interior of each cavity, the gap having an outer segment extending radially outward from the exterior of the spindle and intersecting with the outer surface to form an opening;

a bearing element disposed within each gap between the exterior of the respective spindle and the interior of the respective cavity;

a seal element disposed within each gap and sealing between the respective spindle and the interior of the respective cavity; and a diverter ring disposed on the exterior of each spindle proximate to the respective inside surface and located within the opening to the respective gap, the diverter ring comprising:

a cylindrical disk; and a plurality of ribs extending from the disk to divert abrasive fluid flow away from the gap.

2. The drill bit as recited in claim 1, wherein the diverter ring is disposed adjacent to the inside surface of the support arm.

3. The drill bit as recited in claim 1, wherein the diverter ring further comprises:

a first side facing the inner surface of the support arm;

a second opposite side facing the cutter cone;

wherein the ribs extend from the disk on both the first side and on the second opposite side; and wherein the diverter ring is rotatable around the spindle.

4. The drill bit as recited in claim 3, further comprising a clearance gap between the diverter ring and an area formed between the inner surface of the support arm and the cutter cone, the diverter ring operable to rotate at a rate slower than that of the respective cutter cone.

5. The drill bit as recited in claim 3, wherein the ribs of the first side of the diverter ring are angled away from the direction of rotation of the diverter ring as measured from a radius at an inside diameter of the diverter ring.

6. The drill bit of claim 3, wherein the ribs of the second side of the diverter ring are angled toward a direction of rotation of the diverter ring as measured from a radius at an inside diameter of the diverter ring.

7. The drill bit as recited in claim 3, further comprising a chamfer or radius formed on an inside diameter of the diverter ring.

8. The drill bit as recited in claim 1, further comprising a flange between the diverter ring and the seal element, the flange operable to protect the seal element from rotation of the diverter ring.

9. The drill bit as recited in claim 1, wherein the ribs extend from the disk on only a first side of the diverter ring, a second opposite side of the diverter ring coupled to the cutter cone to prevent abrasive fluid flow therebetween, and whereby the diverter ring is operable to rotate with the cutter cone.

10. The drill bit as recited in claim 9, wherein the ribs of the first side of the diverter ring are angled away from a direction of rotation of the diverter ring as measured from a radius at an inside diameter of the diverter ring.

11. The drill bit as recited in claim 9, further comprising a chamfer or radius formed on the inside diameter of the diverter ring.

12. The drill bit as recited in claim 9, further comprising an energizer coupling the second side of the diverter ring against the cutter cone.

13. The drill bit as recited in claim 1, wherein the ribs extend from the disk on only a second side of the diverter ring, a first side of the diverter ring coupled to the inner surface of the support arm to prevent abrasive fluid flow therebetween, and whereby the diverter ring is not rotatable.

14. The drill bit as recited in claim 13, wherein the ribs of the second side of the diverter ring are angled toward a direction of rotation of the diverter ring as measured from a radius at an inside diameter of the diverter ring.

15. The drill bit as recited in claim 13, further comprising an energizer coupling the first side of the diverter ring against the inner surface of the support arm.

16. A diverter ring for a rotary cone drill bit, the diverter ring comprising:

a cylindrical disk for rotation about a spindle of said rotary cone drill bit; and a plurality of ribs extending from the disk to divert abrasive fluid flow away from a sealing element of said drill bit.

17. The diverter ring as recited in claim 16, wherein the diverter ring further comprises:

a first side for facing an inner surface of a support arm of said drill bit;

a second opposite side for facing a cutter cone of said drill bit; and wherein the ribs extend from the disk on both the first side and on the second opposite side.

18. The diverter ring as recited in claim 17, wherein the ribs of the first side of the diverter ring are angled away from a direction of rotation of the diverter ring as measured from a radius at an inside diameter of the diverter ring.

19. The diverter ring as recited in claim 17, wherein the ribs of the second side of the diverter rings are angled toward a direction of rotation of the diverter ring as measured at a radius at an inside diameter of the diverter ring.

20. The diverter ring as recited in claim 16, further comprising a chamfer or radius formed on an inside diameter of the diverter ring.

21. A method of fabricating a rotary cone drill bit used to form a borehole, comprising the steps of:

forming a bit body having an upper portion adapted for connection to a drill string to rotate the bit body;

forming a plurality of angular spaced support arms extending from the bit body with each support arm having an inside surface;

forming a spindle on each inside surface projecting generally downwardly and inwardly with respect to its associated support arm;

forming a plurality of cutter cones equal to the number of support arms;

forming a plurality of diverter rings equal to the number of support arms and placing one of the diverter rings on the exterior of each spindle approximate to the respective inside surface;

the step of forming a diverter ring comprises the steps of:

forming a cylindrical disk;

forming a plurality of ribs extending from the disk; and mounting each cutter cone on its respective spindle with a generally cylindrical gap formed between the exterior of the spindle and the interior of the respective cutter cone with the respective diverter ring disposed in an opening formed by the gap.

22. The method of claim 21, further comprising the step of energizing the diverter ring against an opposite surface.

* * * * *